United States Patent [19]

Buckholdt

[11] 4,111,644

[45] Sep. 5, 1978

[54] ROTARY HEARTH FURNACE WITH PREHEAT CONVEYOR

[75] Inventor: Robert E. Buckholdt, Abington, Pa.

[73] Assignee: Selas Corporation of America, Dresher, Pa.

[21] Appl. No.: 788,832

[22] Filed: Apr. 19, 1977

[51] Int. Cl.[2] ..... F27B 9/16

[52] U.S. Cl. ..... 432/179; 432/82; 432/138; 432/177

[58] Field of Search ..... 432/138, 82, 177, 179

[56] References Cited

U.S. PATENT DOCUMENTS

| | | | |
|---|---|---|---|
| 457,589 | 8/1891 | DeNavarro | 432/179 X |
| 1,576,371 | 3/1926 | Seeber | 432/138 |
| 2,296,791 | 9/1942 | Keener et al. | 432/138 X |
| 2,530,595 | 11/1950 | Blaha | 432/82 |

*Primary Examiner*—Martin P. Schwadron

*Assistant Examiner*—Richard Gerard

*Attorney, Agent, or Firm*—Miller & Prestia

[57] ABSTRACT

Rotary furnace and preheater structure, wherein a billet is heated on an enclosed preheat conveyor where waste gases from the rotary hearth furnace preheat the billet counter to the billet travel direction. The preheated billet is inserted into the rotary hearth furnace wherein combustion gases, exiting from burners mounted in the furnace roof or sidewalls, flow counter to the hearth rotation direction and exit into the enclosed preheat conveyor. A baffle, depending from the stationary furnace roof, controls combustion gas movement counter to the billet travel direction in the furnace, and forces the combustion gases out of the furnace through a flue communicating with the preheat conveyor. A source of aspiration is provided to communicate with the preheat conveyor, and thus to facilitate combustion gas movement therethrough.

11 Claims, 3 Drawing Figures

ROTARY HEARTH FURNACE WITH PREHEAT CONVEYOR

BACKGROUND OF THE INVENTION

1. Field of the Invention

This invention relates to a rotary hearth furnace having enclosed preheater means connected thereto whereby combustion gases from the rotary furnace are caused to exit the furnace and enter the preheater section to preheat the work.

2. Description of the Prior Art

Rotary hearth furnaces are known wherein an annular floor or hearth is rotated within a chamber formed by refractory material. See for example U.S. Pat. No. 1,576,371 (Seever) and 2,296,791 (Keener et al).

Moreover, induction furnaces having both preheat and combustion chambers are known wherein the higher temperature combustion chamber provides heat to a lower temperature preheat section. See U.S. Pat. No. 1,403,316 (Gaskill).

Also, two chamber rotary furnaces comprising a first stage high temperature cylinder and a second stage lower temperature cylinder are known. See U.S. Pat. No. 457,589 (De Navarro).

In heating metallic objects, certain metals have been found to crack upon being suddenly thrust into a hot hearth without having been preheated. Moreover, it is desirable for subsequent processing that the work piece be evenly heated, i.e., the inner core and external surface should be heated to substantially the same temperature.

A rotary hearth furnace differs substantially from an in-line furnace in that the entrance always involves a hot hearth. In prior practice, where a cold billet was fed to a hot hearth, excessive scaling was encountered. Also, this procedure resulted in heating the outside of the billet much more than the center. Also, productivity suffered because of the extra time needed to transfer the heat into the center of the billet.

Conservation of fuel has become increasingly important. In an in-line furnace production can be increased (as can thermal efficiency) by simply increasing the length of the furnace. However, this is very difficult to do in an existing rotary furnace, because of its inherent principle. This has been a serious problem in the art.

OBJECTS OF THE INVENTION

It is an object of this invention to provide a high temperature rotary hearth furnace that heats the inner core and outer surface of the metallic work to substantially the same temperature.

Still another object of this invention is to provide a means for decreasing fuel consumption and for increasing production of an existing rotary hearth furnace.

Another object is to provide furnace and preheater structure wherein combustion gas from the furnace is economically utilized to heat the work in the preheat section and then is recovered to heat the air for combustion utilized to fire the furnace.

BRIEF DESCRIPTION OF THE INVENTION

The foregoing and other objects of this invention are attained by the novel rotary hearth furnace and preheat structure disclosed herein.

Basically, the furnace includes an annular outer sidewall surrounding the rotatable hearth, and an annular roof spanning the hearth that is usually packed or sealed to the sidewall. An enclosed preheat conveyor is disposed about the outer periphery of the sidewall, and communicates with the furnace through a flue channel or the like. Part of the preheat conveyor housing is cut away at an unloading and loading station so that the work can be placed onto the preheat conveyor and, subsequent to preheating, taken off the preheat conveyor and loaded into the hot rotary hearth furnace.

A baffle depends from the stationary roof of the furnace and extends vertically downwardly, just allowing the metallic work to pass thereunder during rotation of the hearth. The baffle forces combustion gas exiting from the burners, mounted either in the furnace roof or sidewalls, to flow counter the hearth rotational direction. Also, the baffle forces the counter-flowing combustion gases out of the furnace, through the flue, and into the preheat area. The articles disposed on the preheat conveyor travel counter to the directional flow of the thus exiting waste combustion gases.

A vertical stack gas recuperator communicates with the enclosed preheater near the work load - unload station. The recuperator removes combustion gases from the preheat area after they have travelled almost completely around the periphery of the furnace. The recuperator thus forms a source of aspiration, pulling the travelling combustion gases through the preheater.

DETAILED DESCRIPTION OF THE INVENTION

In the following detailed specification and accompanying drawings a preferred embodiment of the invention is shown and described. Reference to this specific embodiment is not intended to limit the scope of this invention, which is defined in the claims.

IN THE DRAWINGS

Figure 1:
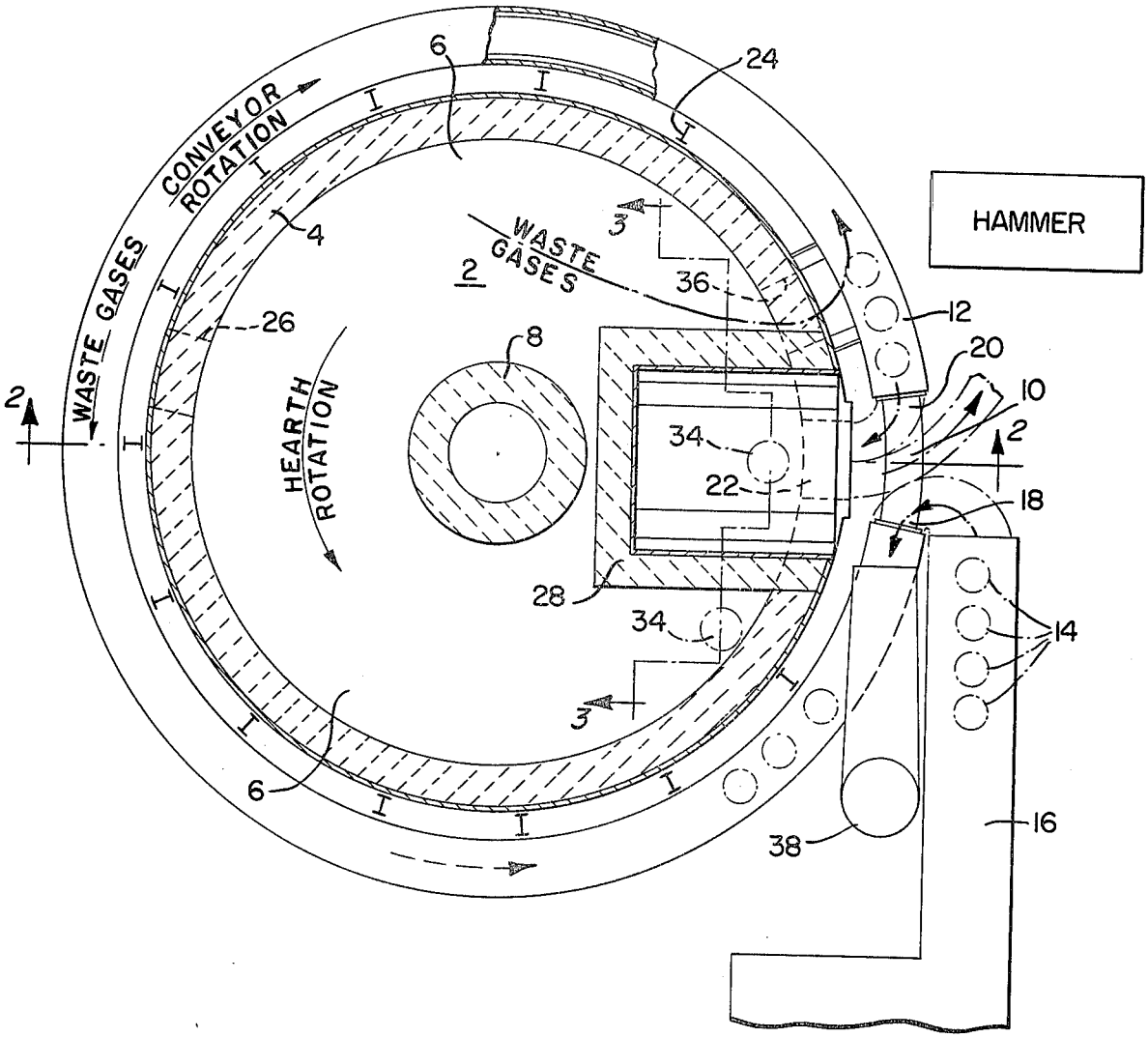
FIG. 1 is a plan view of a specific form of rotary hearth furnace and enclosed preheat conveyor with the furnace roof and outer cover cut away so as to better illustrate the apparatus.

With reference to the drawings and especially to FIG. 1, there is shown a rotary hearth furnace 2 having annular refractory sidewalls 4 which surround rotatable hearth 6. Concentric with the axis of rotatable hearth 6 is annular dead man's pier 8 which functions as a space filler, and which rotates with the hearth 6.

Surrounding the sidewalls 4 is a preheat conveyor 10 enclosed by a housing 12. Due to the fact that optimal desired temperatures in the preheat zone rarely exceed 950° F., housing 12 mat be made of steel with a lightweight insulating blanket, economizing over more expensive refractory material.

As shown in FIG. 1, steel billets 14 are transported by conveyor 16 to preheat conveyor loading station 18 where they are placed (manually or otherwise) on preheat conveyor 10, where they travel clockwise as viewed in FIG. 1, countercurrent to hot preheating gases which flow counter-clockwise in the same annular passageway, as will further be developed in detail hereinafter. After almost a full revolution around the furnace, the preheated billets 14 are unloaded at unloading station 20, and are then inserted into the hot rotary hearth furnace 2 through door 22 formed in the furnace sidewall. The furnace 2 is rotated counter-clockwise as viewed in FIG. 1. An opening is, of course, provided in housing 12 to provide loading and unloading stations to facilitate easy manual or other handling of the billets 14. The functions of loading and unloading both the preheat conveyor and the furnace can of course be performed mechanically.

Still referring to FIG. 1, sidewalls 4 are separated from preheat conveyor 10 and housing 12 by interposition of "I" beam braces 24 therebetween. Access door 26, formed in sidewall 4, provides access to the furnace interior for repair, cleaning and the like.

Figure 3:
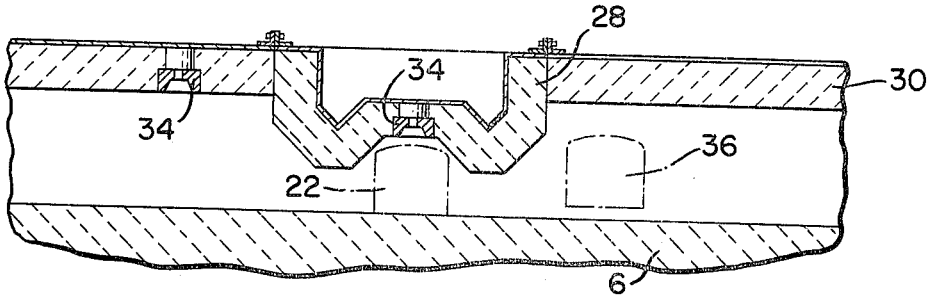
FIG. 3 is a sectional view taken as indicated by the lines and arrows 3—3 of FIG. 1.
Figure 2:
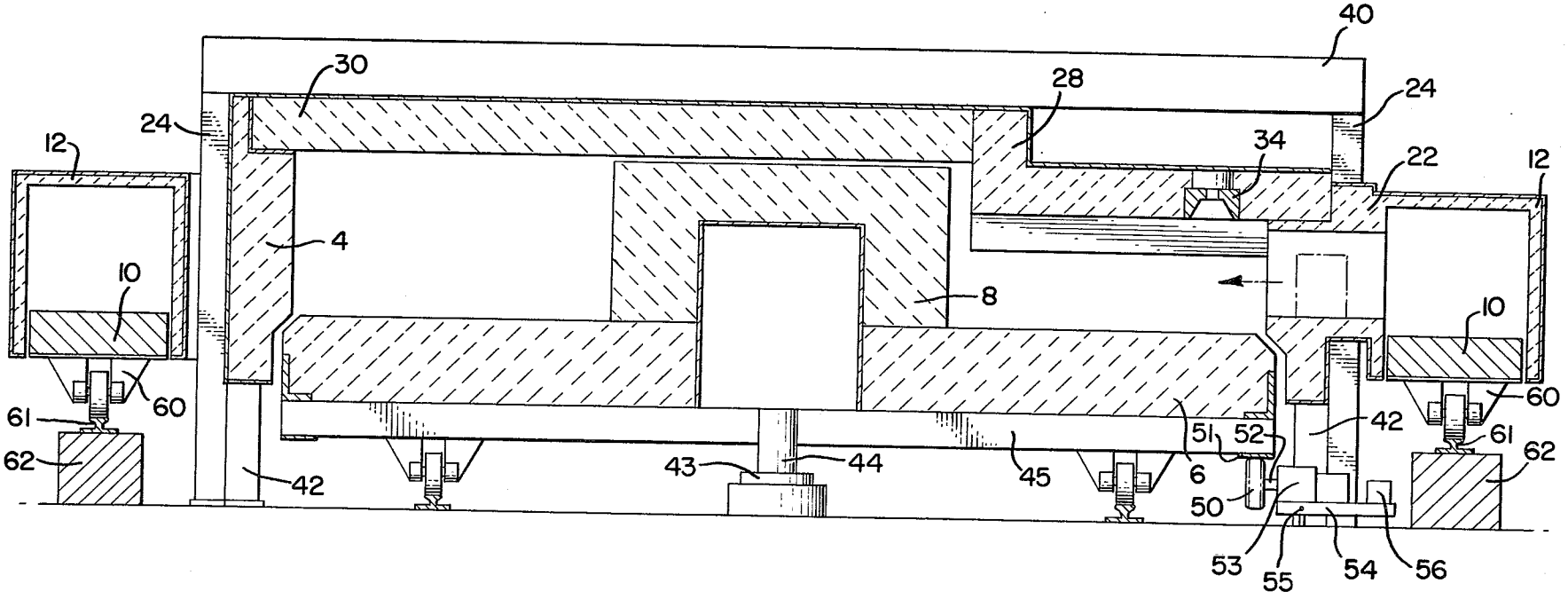
FIG. 2 is a cross sectional view taken as indicated by the lines and arrows 2—2 of FIG. 1.

Baffle 28, shown in all of FIGS. 1–3, depends from furnace roof 30 and extends vertically downwardly, leaving just enough room for the billets 14 to pass thereunder. Annular furnace roof 30, shown particularly in FIGS. 2 and 3, is of suitable refractory material, is sealed to the sidewall and spans the furnace. Upon counter-clockwise rotation of hearth 6, combustion gases exiting from burners 34 are caused to flow in a clockwise direction, around to the flue 36, counter to the counter-clockwise hearth rotational direction. Accordingly, the billets traverse the counter-flowing gases and are heated countercurrently in the furnace 2.

Preferably, a plurality of burners are mounted either in the furnace roof or sidewalls. Most preferably, the burners are adapted to utilize either fuel oil, powdered coal or gas as their fuel. Baffle 28 acts like a curtain and prevents the combustion gases from continuing their clockwise flow in the furnace 2, and diverts them out the flue 36 into housing 12 to flow in a counter-clockwise direction, counter to the clockwise billet travel direction in the preheater. Accordingly, the combustion gases flow counter to the billet travel direction around both the hearth 2 and the preheat conveyor 12.

Thus, the hottest exhaust gases contact the hottest billets on the preheat conveyor in the vicinity of the flue 36, and the coolest exhaust gases contact the cold billets at their point of introduction into the preheat conveyor. This is the preferred condition.

Vertical stack gas recuperator 38 communicates with housing 12 near the billet loading and unloading station. Recuperator 38 removes the combustion gases that have made their journey through the enclosed conveyor, thus pulling the combustion gas exiting from the furnace through the enclosed preheat conveyor. The removed gases may be recycled to preheat the combustion air needed to fuel the burners.

After a substantially complete revolution of the rotary hearth, the heated billet is removed through door 22 and transported to the forging station (referred to as a hammer in FIG. 1).

The preferred baffle shape as seen in FIG. 3 is substantially that of a depressed roof, shown in the drawings as substantially "W" shaped. It is built like a part of the roof, with substantial insulation, but lower.

FIG. 2 shows I-beam 40 supported by vertical I-beams 24. Sidewalls 4 are mounted on stationary support members 42.

Hearth 6 may be mounted on a suitable steel frame 45. The hearth 6 is held central by a central bearing 43 and supported by a post 44 secured to the hearth structure itself.

The hearth is driven by a (rubber) tire 50 which bears against a steel ring 51 carried by the hearth 6. Tire 50 is rotated by shaft 52 driven by motorized speed reducer 53 mounted on a channel 54 pivoted at 55 and provided with a counterweight 56 to exert pressure between tire 50 and steel ring 51. The hearth may alternatively be rotated by conventional drive means such as a sprocket wheel in engagement with pin members supported on an annular steel rail depending from the hearth frame. Such drive means are shown in U.S. Pat. No. 2,296,791 (Keener et al), and do not of themselves constitute part of this invention.

The conveyors 10 utilized in the invention are of the type commonly available, usually steel rollers, preferably a plurality of driven, horizontally disposed rollers. They may be driven or indexed by rubber tires similar to tire 50 previously described, and not repeated in FIG. 2. The number 60 designates support rolls for the rollers 10, themselves supported by track 61 mounted on foundation 62. The conveyor structure, being well known in the art, does not of itself consititute part of this invention.

Accordingly, there is provided a novel rotary hearth furnace and preheater structure that provides for an even heating of the desired metallic object, and that minimizes chances of cracking and scaling that have heretofore presented problems in the art of high temperature treatment of metallic objects. For example, the temperature in the preheating zone may be kept so the billets are heated to about 950° F., while the hearth temperature itself may be high enough to heat the billets to about 2,300° F. Since the surface of the billet is at maximum temperature for a relatively short period of time, as compared to direct heating of a cold billet, much less scale forms on the surface of the billet.

Also, the subsequent use of combustion gas from the furnace to preheat the objects and then to preheat the combustion air to fuel the burners provides an economic fuel recycling system resulting in considerable fuel savings.

It is important and advantageous to provide a depressed roof of the type shown and described herein. It may be composed of metal with ceramic reinforcement, and provides depressed baffles arranged to cause directional flow of the waste gases from the burners. Specifically, it diverts waste gases to the preheater, causing them to flow counter to the direction of the work travel, all around the circumference of the furnace. This causes the waste gases to flow around and out the flue, functioning like a curtain, preventing passage of such gases across the feed door of the furnace.

Although one might consider the use of a hung baffle in a structure of this type, this is quite impractical because it would not be feasible to anchor the inner end of such a hung baffle; the "dead man" pillar rotates, whereas the baffle must stand still. In accordance with this invention, the baffle is anchored to the plate directly, as shown in the drawings, and this is a construction feature considered highly advantageous.

This invention is highly important commercially, particularly in view of the criticality of saving fuel. In practice, this invention is considered to save up to about 30% of the fuel otherwise required in a conventional rotary hearth furnace. In view of the fact that the furnace is a rotary hearth furnace, the hearth is at a high enough temperature to heat the billets to a temperature such as 2,300° F., at the time that the billet is placed upon it. If the billet were cold at this point, the entire heating process would be conducted at a time when the surface of the billet is exposed to the above 2,300° F. temperature of the furnace. By way of contrast in accordance with this invention, the cold billet is exposed to the preheat temperature only, and is not subjected to scaling to any considerable degree during the period that it is preheated to 950° F., more or less, by the waste gas counter flow. Accordingly, the final billet has less scale than heretofore, because the surface was not maintained at maximum temperature for as long a time as if it were fed directly into the furnace as a cold billet. Further, preheating produces a substantially uniform temperature (at a level of about 950° F., more or less), throughout the entire billet.

It is, further, a great advantage of this invention that the preheat section can readily and quite inexpensively be added to an existing rotary hearth furnace. This provides greatly improved thermal efficiency an significantly increases its productivity.

Although this invention has been illustrated and described in conjunction with a furnace which rotates counter-clockwise and a preheat conveyor which rotates clockwise, both of these directions may be reversed while still maintaining countercurrent flow throughout, with suitable placement of the passageway through which the combustion gases flow from the furnace to the preheat conveyor. Further, the flow-diverting feature of this invention is of value and importance even if it is elected to rotate both furnace and preheat conveyor in the same direction, or to provide co-current flow instead of countercurrent flow in either the furnace or the preheat conveyor, or both.

Although this invention has been described with respect to certain preferred embodiments, it will be appreciated that a wide variety of equivalents may be substituted for those specific elements shown and described herein, all without departing from the spirit and scope of the invention as defined in the appended claims.

I claim:

1. A rotary hearth furnace for heating work pieces comprising:

(a) means forming a rotatable hearth having a roof thereon;

(b) combustion means within said furnace and emitting hot gases therein;

(c) a substantially enclosed preheat conveyor disposed about the outside periphery of said hearth and provided with means to move said work pieces about said periphery;

(d) passage means providing gas communication from said furnace to said preheat conveyor;

(e) means forming a loading and unloading station for the preheat conveyor and for the furnace; and (f) flow diverting means within said furnace for diverting the flow of combustion gases from said heating means through said passage means (d) and into said preheat conveyor, said passage means being located to provide a combustion gas current that is counter to the hearth travel direction and also counter to the travel direction of said work pieces on said preheat conveyor.

2. A furnace as defined in claim 1 wherein said flow diverting means (f) includes a baffle depending from said roof, said baffle extending vertically downwardly.

3. A furnace as defined in claim 2 wherein said furnace further includes a means forming a source of aspiration communicating with said preheat conveyor.

4. A furnace as defined in claim 3 wherein said means forming a source of aspiration comprises a vertical stack gas recuperator.

5. A furnace as defined in claim 2 wherein said baffle is substantially "W" shaped.

6. A furnace a defined in claim 1 wherein said loading and unloading means (e) comprises a cutaway portion of said preheat conveyor enclosure, and a door formed in said sidewall.

7. A furnace as defined in claim 1 wherein said heating means comprises a plurality of burners.

8. A furnace as defined in claim 1 further including a dead pier concentric with the axis of rotation of said hearth and mounted thereon.

9. A furnace as defined in claim 1 wherein means are provided for rotating said hearth in a predetermined direction, and wherein means are provided for rotating said preheat conveyor in the opposite direction.

10. A furnace as defined in claim 1 wherein said passage means is located in the vicinity of the exit of the work pieces from said preheat conveyor, whereby substantially the hottest gases contact substantially the hottest work pieces on the preheat conveyor.

11. The furnace defined in claim 1, wherein the work piece loading station is substantially in the vicinity of the combustion gas exit from the preheater, whereby substantially the coolest combustion gases contact substantially the coolest work pieces.

* * * * *